US007451975B2

(12) United States Patent
Cook et al.

(10) Patent No.: US 7,451,975 B2
(45) Date of Patent: Nov. 18, 2008

(54) INPUT TRAY AND DRIVE MECHANISM USING A SINGLE MOTOR FOR AN IMAGE FORMING DEVICE

(75) Inventors: William Paul Cook, Lexington, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 106 days.

(21) Appl. No.: 10/803,822

(22) Filed: Mar. 18, 2004

(65) Prior Publication Data

US 2005/0206067 A1 Sep. 22, 2005

(51) Int. Cl.
*B65H 35/06* (2006.01)
*B65H 5/02* (2006.01)
*B65H 5/04* (2006.01)

(52) U.S. Cl. ..... 271/117; 271/274; 271/3.14

(58) Field of Classification Search ..... 271/10.01, 271/10.11, 10.03, 113, 270, 272, 117, 3.14, 271/274

See application file for complete search history.

(56) References Cited

U.S. PATENT DOCUMENTS 4,320,953 A 3/1982 Schultes et al.
4,411,511 A 10/1983 Ariyama et al.
4,566,684 A 1/1986 Gysling
4,577,849 A 3/1986 Watanabe
4,580,917 A 4/1986 Hibino
4,589,765 A 5/1986 Perun et al.
4,638,987 A 1/1987 Sakurai
4,660,821 A 4/1987 Boser et al.
4,682,769 A 7/1987 Murakami et al.
4,721,297 A 1/1988 Katayama
4,744,687 A 5/1988 Nukaya et al.
4,754,961 A * 7/1988 Tokuda et al. ..... 271/114
4,766,463 A 8/1988 Watanuki et al.
4,790,524 A 12/1988 Murakami et al.
4,809,969 A 3/1989 Bastow et al.
4,866,531 A * 9/1989 Kobori et al. ..... 358/400
4,868,609 A 9/1989 Nagata et al.
4,884,796 A 12/1989 Daboub
4,900,003 A 2/1990 Hashimoto
4,986,525 A * 1/1991 Takagi et al. ..... 271/114
4,990,011 A 2/1991 Underwood et al.
5,056,771 A 10/1991 Beck et al.
5,080,515 A * 1/1992 Engelhardt et al. ..... 400/624
5,121,914 A 6/1992 Hargreaves
5,121,915 A 6/1992 Duncan et al.
5,141,217 A 8/1992 Lim et al.
5,155,603 A * 10/1992 Seok-Jae ..... 358/498
5,197,726 A 3/1993 Nogami (Continued)

*Primary Examiner*—Gene O. Crawford
*Assistant Examiner*—Rakesh Kumar

(57) ABSTRACT

A device and method for moving media sheets within an image forming apparatus. The device includes a motor; a pick mechanism operatively connected to the motor, a first gear set having a first ratio and operatively connecting the motor to the pick mechanism, a feed nip operatively connected to the motor to receive the media sheet and forward the media sheet along a media path, and a second gear set having a second gear ratio and operatively connecting the motor to the feed nip. The motor may operate at a constant speed and drive the pick mechanism at a first speed and the feed nip at a second speed. The first and second speeds may be the same, or the speeds may be different.

8 Claims, 5 Drawing Sheets

U.S. PATENT DOCUMENTS 5,211,690 A 5/1993 Mizoguchi et al.
5,226,639 A 7/1993 Kida et al.
5,277,415 A 1/1994 Kinoshita et al.
5,393,044 A 2/1995 Hagihara et al.
5,419,543 A * 5/1995 Nakamura et al. ..... 271/9.01
5,423,527 A 6/1995 Tranquilla
5,465,955 A 11/1995 Krupica et al.
5,480,132 A 1/1996 Kiyohara et al.
5,495,326 A 2/1996 Mikida
5,501,444 A 3/1996 Yukimachi et al.
5,507,478 A 4/1996 Nottingham et al.
5,523,858 A * 6/1996 Yamada et al. ..... 358/412
5,580,046 A 12/1996 Beaufort et al.
5,601,281 A 2/1997 Kubodera et al.
5,651,538 A 7/1997 Chung et al.
5,664,771 A * 9/1997 Nagatani et al. ..... 271/10.03
5,667,215 A 9/1997 Yoshino
5,691,826 A 11/1997 Yeh et al.
5,692,741 A 12/1997 Nakamura et al.
5,755,435 A 5/1998 Fujiwara
5,791,646 A * 8/1998 Luo et al. ..... 271/10.11
5,823,523 A * 10/1998 Park ..... 271/10.04
5,826,135 A 10/1998 Lee
5,854,696 A 12/1998 Yun
5,862,447 A * 1/1999 Matsumura ..... 399/388
5,876,032 A * 3/1999 Kato ..... 271/114
5,878,321 A 3/1999 Miyazaki et al.
6,019,363 A * 2/2000 Ahn ..... 271/10.05
6,076,821 A 6/2000 Embry et al.
6,139,010 A 10/2000 Yokoi
6,170,816 B1 1/2001 Gillmann et al.
6,178,863 B1 * 1/2001 Kobayashi et al. ..... 83/649
6,227,534 B1 * 5/2001 Schoedinger et al. ..... 271/114
6,330,424 B1 12/2001 Chapman et al.
6,349,931 B1 * 2/2002 Kuo et al. ..... 271/110
6,382,618 B1 5/2002 Takada
6,382,619 B1 * 5/2002 Gustafson et al. ..... 271/117
6,446,954 B1 * 9/2002 Lim et al. ..... 271/10.04
6,519,443 B1 2/2003 Coriale et al.
6,568,674 B2 * 5/2003 Matsuda ..... 271/274
6,648,322 B2 * 11/2003 Park ..... 271/117
6,679,490 B2 1/2004 Pioquinto et al.
6,738,596 B2 * 5/2004 Kamimura et al. ..... 399/396
6,765,698 B1 * 7/2004 Ha ..... 358/474
6,837,489 B2 * 1/2005 Kim ..... 271/3.14
6,942,215 B2 * 9/2005 Kang et al. ..... 271/265.01
6,948,871 B1 * 9/2005 Onishi et al. ..... 400/679
2004/0100545 A1 * 5/2004 Kang ..... 347/104
2004/0109056 A1 * 6/2004 Kang ..... 347/104
2004/0141785 A1 * 7/2004 Kang ..... 400/578

* cited by examiner

INPUT TRAY AND DRIVE MECHANISM USING A SINGLE MOTOR FOR AN IMAGE FORMING DEVICE

BACKGROUND

Image forming devices include input trays for introducing media into a media path. A pick mechanism is associated with the input tray for initially picking and moving the media sheet. The pick mechanism extends into the input tray and includes one or more rollers that contact and move the media sheet from the tray. The pick mechanism may only move the media sheet a limited distance along the media path before the sheet moves out of range. A downstream drive mechanism receives the media sheet from the pick mechanism and moves it further along the media path. In some instances, the drive mechanism is in proximity to the pick mechanism.

It is important for media sheets to move accurately along the media path. The media sheets are contacted by different mechanisms that contact and propel the sheets along the media path. The hand-off of a media sheet from one mechanism to another often times causes problems. One type of problem during hand-off is accurately maintaining the location of the media sheet. Print defects occur such as incorrect lower and upper margins when the media sheet is moved too fast or slow along the media path. Another problem is media jams caused by the media sheet becoming skewed during the hand-off between mechanisms.

The image forming device should be constructed in an economical manner. Price is one of the leading factors when a user makes a purchasing decision. Components within the device may be shared for different functions thus allowing for fewer overall parts, and a lower overall cost. The components that may be shared should not detract from the reliability of the device, such that the overall savings in cost is tainted by poor performance characteristics.

SUMMARY

The present invention is directed to a motor that drives two separate media moving devices along a media path of an image forming device. In one embodiment, the device includes the motor operatively connected to a pick mechanism that is positioned to move a media sheet from an input tray. A first gear set having a first ratio and operatively connects the motor to the pick mechanism. The motor is also operatively connected to a feed nip that receives the media sheet and forwards it along a media path. The feed nip is positioned downstream from the pick mechanism a distance less than a length of the media sheet. A second gear set having a second gear ratio operatively connects the motor to the feed nip. The motor operates at a constant speed and drives the pick mechanism at a first speed and the feed nip at a second speed. The first and second speeds may be the same or may be different.

A swing arm may be positioned within one of the gear sets. The swing arm includes a first arm having an even set of gears, and a second arm having an odd number of gears. Clutches may be positioned on the feed nip and the pick roll to not interfere with the movement of the media sheet along the media path as it moves at different speeds.

DETAILED DESCRIPTION

Figure 1:
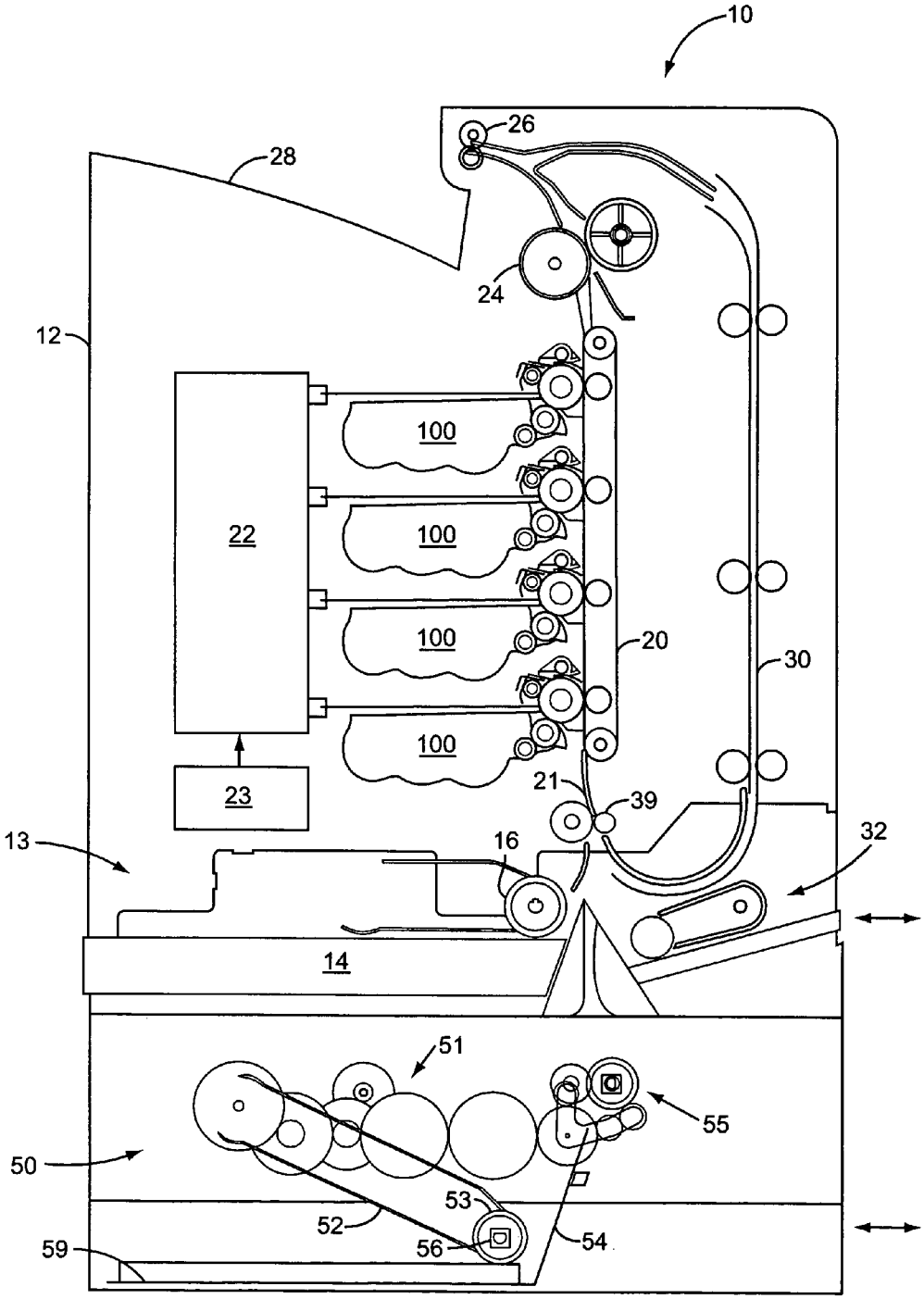
FIG. 1 is a schematic illustration of an image forming device according to one embodiment of the present invention.

FIG. 1 depicts a representative image forming device, such as a printer, indicated generally by the numeral 10. A first input section 13 includes a media tray 14 with a pick mechanism 16 to introduce media sheets into the media path 21. A manual input 32 may also be located in a main body 12 to introduce media sheets into the media path 21. A second input section 50 is also located in the main body 12 below the first media tray 14. The second input section 50 includes a second pick mechanism 51 that picks sheets from input tray 59. In one embodiment, the input tray 59 has a larger capacity than tray 14 to hold a greater number of sheets, such as a capacity of 500 sheets. Multiple input trays also allow for storing multiple types of media that may be picked and introduced into the media path 21 as required. A feed nip 55 is located downstream from the pick mechanism 51 to receive the sheets and forward them along the media path 21. The media trays 14, 59 are preferably removable for refilling, and located on a lower section of the device 10.

Media sheets are fed into the media path 21. One or more registration rollers 39 disposed along the media path 21 align the media sheet and precisely control its further movement. A media transport belt 20 forms a section of the media path 21 for moving the media sheets past a plurality of image forming units 100. Color image forming devices typically include four image forming units 100 for printing with cyan, magenta, yellow, and black toner to produce a four-color image on the media sheet.

An imaging device 22 forms an electrical charge on a photoconductive member within the image forming units 100 as part of the image formation process. The media sheet with loose toner is then moved through a fuser 24 that adheres the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

Figure 2:
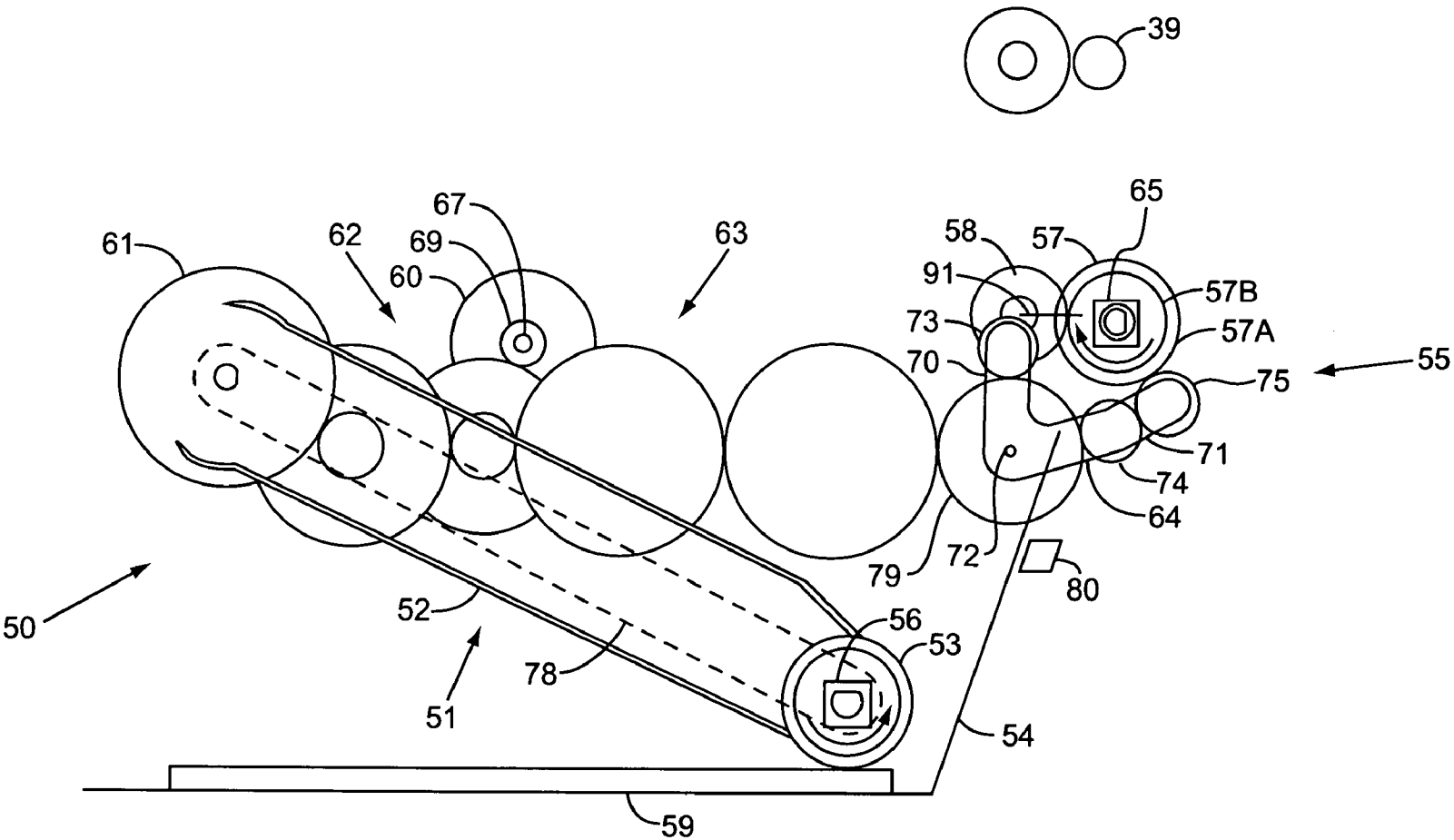
FIG. 2 is a schematic illustration of a shared motor arrangement in a first orientation according to one embodiment of the present invention.
Figure 3:
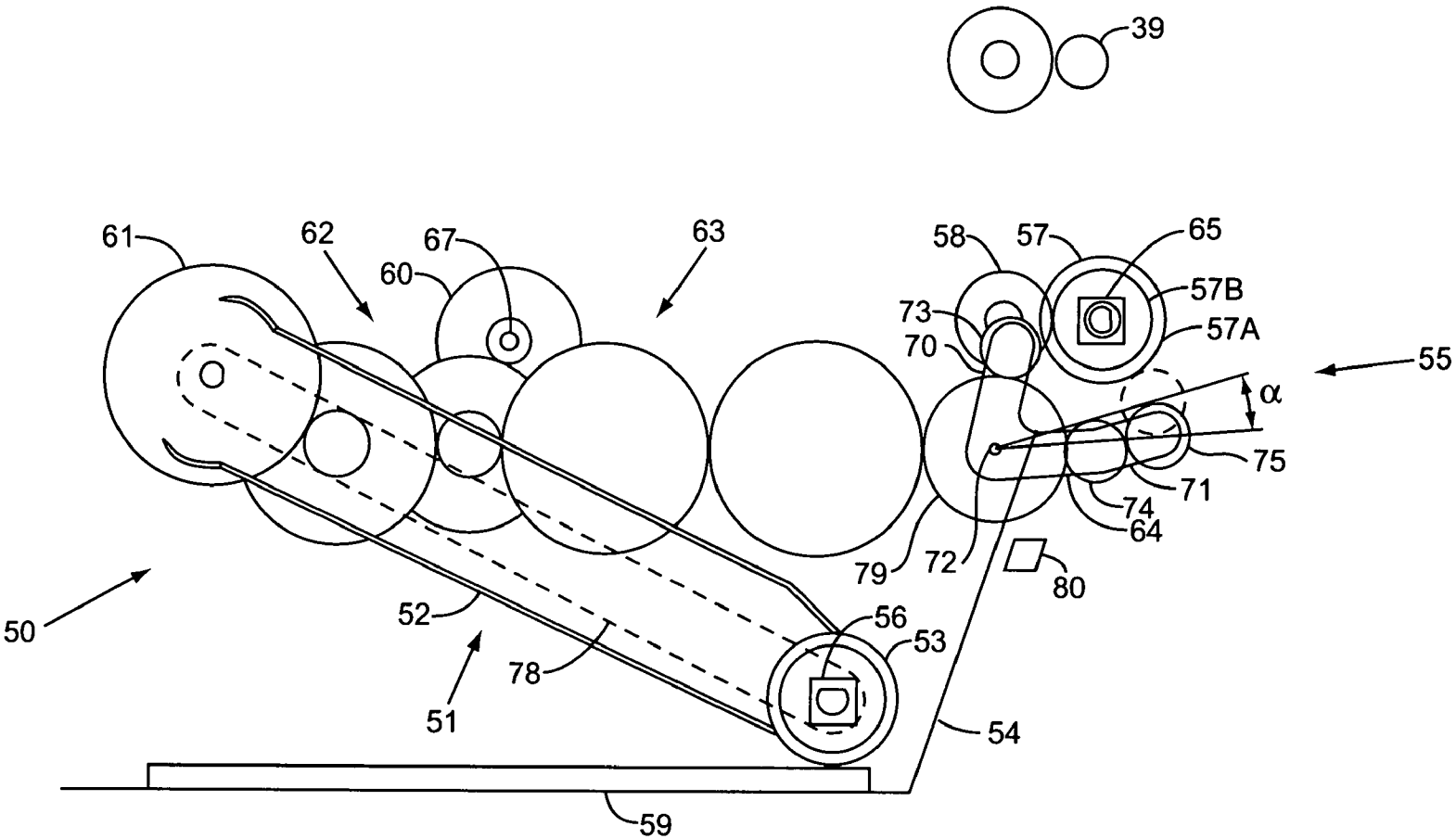
FIG. 3 is a schematic illustration of a shared motor arrangement in a second orientation according to one embodiment of the present invention.

FIG. 2 illustrates the second input section 50. The pick mechanism 51 includes a pick arm 52 with one or more pick rolls 53 at a distal end. Either the weighting of the pick arm 52 or a biasing mechanism (not illustrated) positions the pick roll 53 on the surface of the uppermost media sheet in the tray 59. The pick arm 52 pivots about the pick arm drive shaft 61 and the pick roll 53 remains in contact with the media sheets as the amount of media within the tray 59 varies. By way of example, FIGS. 2 and 3 illustrate a small number of media sheets within the tray 59, and FIG. 1 illustrates a larger number of media sheets. The pick roll 53 is driven to rotate in a counter-clockwise direction as viewed in FIG. 2 to drive the media sheets from the tray 59. A clutch 56 may be operatively connected to the pick roll 53 to cause free rotation when the media sheets are moved by the feed nip 55 at a faster rate as will be explained in detail below. Additionally, clutch 56 prevents the pick roll 53 from rotating in a reverse direction when the motor 60 operates in a reverse direction. One embodiment of a pick mechanism and clutch is disclosed in U.S. patent application Ser. No. 10/436,406 entitled "Pick Mechanism and Algorithm for an Image Forming Apparatus" filed May 12, 2003, assigned to Lexmark International, Inc., and herein incorporated by reference in its entirety.

The input tray 59 includes a ramp 54 that extends away from the pick mechanism 51 and guides the picked media sheet towards the feed nip 55. The tray 59 may be independently removed from the device 10 to refill the media sheets, or may be operatively connected to one or more of the pick mechanism 51, motor 60, and feed nip 55 which together are also removed during refilling.

Motor 60 is positioned to drive both the pick roll 53 and feed nip 55. Motor 60 is reversible to provide a driving force in both forward and reverse directions. Motor embodiments may include a stepper motor, or a DC motor with brushes. One type of motor 60 is Model No. RS-385-15155 manufactured by Mabuchi Corporation. In one embodiment, a shaft 69 extends outward from the motor 60 to mate with the first and second gear sets 62, 63.

Motor 60 drives the pick roll 53 via a first gear set 62 and the feed nip 55 via a second gear set 63 each including one or more gears. In one embodiment as illustrated in FIGS. 2 and 3, the first gear set 62 includes two gears that extend between the motor 60 and the pick arm drive shaft 61, and transfer mechanism that transfers the rotation of the pick arm drive shaft 61 to the pick roll 53. In one embodiment, a set of gears, schematically illustrated as 78, is positioned in the pick arm 52 to transfer power from the drive shaft 61 to the pick roll 53.

Rotation of the motor 60 is likewise transferred to the feed nip 55 to drive the sheets along the media path 21. In one orientation, the second gear set 63 includes five gears that extend between the motor 60 and the drive nip roll 57, and in a second orientation the second gear set 63 includes six gears that extend between the motor 60 and the drive nip roll 57.

A swing arm 64 is positioned within the second gear set 63 to operatively connect the motor 60 to control the feed nip 55. The swing arm 64 includes a first arm 70 and a second arm 71 each extending outward from a pivot 72. The swing arm 64 is movable about the pivot 72 between a first orientation as illustrated in FIG. 2 and a second orientation as illustrated in FIG. 3. In one embodiment, the angle of movement a is about 10°.

The first arm 70 includes a gear 73 mounted at a distal end. Gear 73 is positioned to extend between the contact gear 79 mounted at the pivot 72, and to contact the driven nip roll 57 when the swing arm 70 is in the second orientation as illustrated in FIG. 3. Gears 74, 75 are mounted on the second arm 71. Gear 74 is positioned between gear 79 and gear 75. Gear 75 is positioned on a distal end of the second arm 71 and contacts the driven nip roll 57 in the first orientation as illustrated in FIG. 2. First and second arms 70, 71 may comprise a number of different gears, provided that the number is different on each arm. A different number of gears cause the feed roll 55 to rotate in a forward direction regardless of whether the motor 60 is running in a forward or reverse direction.

The feed nip 55 includes a drive roll 57 and a second roll 58 spaced a distance apart to create a nip through which the media sheets are driven. The drive roll 57 is in operative contact with the second gear set 63 and driven by motor 60. In one embodiment, drive roll 57 includes a first outer edge 57*a* that is contacted by the gears 73, 75. A second edge 57*b* is in contact with and creates the nip with the second roll 58. Second roll 58 is positioned to contact the drive roll 57. A biasing mechanism 91 may bias the second roll 58 to maintain contact with the first roll 57. In one embodiment, second roll 58 is constructed of three small rolls that are spaced apart across the width of the media path. A separate biasing mechanism 91 biases each of the small rolls into contact with the drive roll 57.

In a first orientation as illustrated in FIG. 2, the motor 60 operates in a first direction. The motor 60 drives the pick roll 53 at a first surface velocity via the first gear set 62. Simultaneously, motor 60 also drives the drive roll 57 at a second surface velocity through the second gear set 63. The first gear set 62 and the second gear set 63 may have different ratios such that the motor 60 operating at a constant speed results in the pick roll 53 and drive roll 57 having different surface velocities. In one embodiment, the drive roll 57 has a higher surface velocity than the pick roll 53. When the media sheet is in contact simultaneously with both the pick roll 53 and the feed nip 55, clutch 56 on the pick mechanism 51 allows for the pick roll 53 to rotate at the higher speed of the drive roll 57 to prevent interference with the media sheet. In one embodiment, the gear ratios and drive roll diameters are defined such that the pick roll 53 moves about 1.388 mm per motor revolution and the drive roll 57 moves about 1.395 mm per motor revolution (about 0.5% faster).

While the motor is operating in the first direction, the swing arm 64 is in a first orientation with the gear 75 in contact with and driving the roll 57 as illustrated in FIG. 2. In this embodiment, swing arm 64 is pivoted upward about point 72.

In a second orientation as illustrated in FIG. 3, the drive motor 60 operates in a second direction. Clutch 56 prevents the pick roll 53 from rotating in a reverse direction. As the motor 60 runs in the opposite direction, the swing arm 64 is rotated about pivot 72 caused by the friction with the gear shaft of gear 79. Gear 73 on the first arm 70 engages the drive roll 57, as gear 75 on the second arm 71 moves away from the roll 57. In one embodiment, the swing arm 70 moves approximately 10° about pivot 72. The drive roll 57 continues to rotate in a forward direction (i.e., clockwise as illustrated in FIG. 3) as the motor 60 switches from the first direction to the second direction. This is caused by the different number of gears on the first arm 70 and the second arm 71. It is noted that the media sheet is stationary for a momentary period as the swing arm 70 switches from the first orientation to the second orientation.

The feed nip 55 moves the media sheet along the media path 21 and into the metering nip 39. The metering nip 39 may be rotating with a higher surface velocity than the feed nip 57. A clutch 65 on the drive roll 57 allows the drive roll to maintain contact with the media sheet and rotate at the speed of the metering nip 39 during the simultaneous contact. One or both rolls 57, 58 of the feed nip 55 may include a clutch 65 to allow the media sheet to move through the nip at the faster speed. Clutch 65 allows for one or both rolls 57, 58 to rotate faster than being driven to match the speed of the metering nip 39 and not interfere with the increased media sheet speed.

An encoder 67 associated with the motor 60 may determine a position of the leading edge of the media sheet. Each motor revolution equates to a predetermined rotation of the pick roll 53 and the driven roll 57 and a predetermined movement of the media sheet. Controller 23 receives the encoder output and accurately tracks the location of the media sheet. In another embodiment, a sensor 80 is positioned within the second input section 50. The sensor 80 detects the passing of the leading or trailing edge of the media sheet and sends a signal to controller 23.

Figure 4:
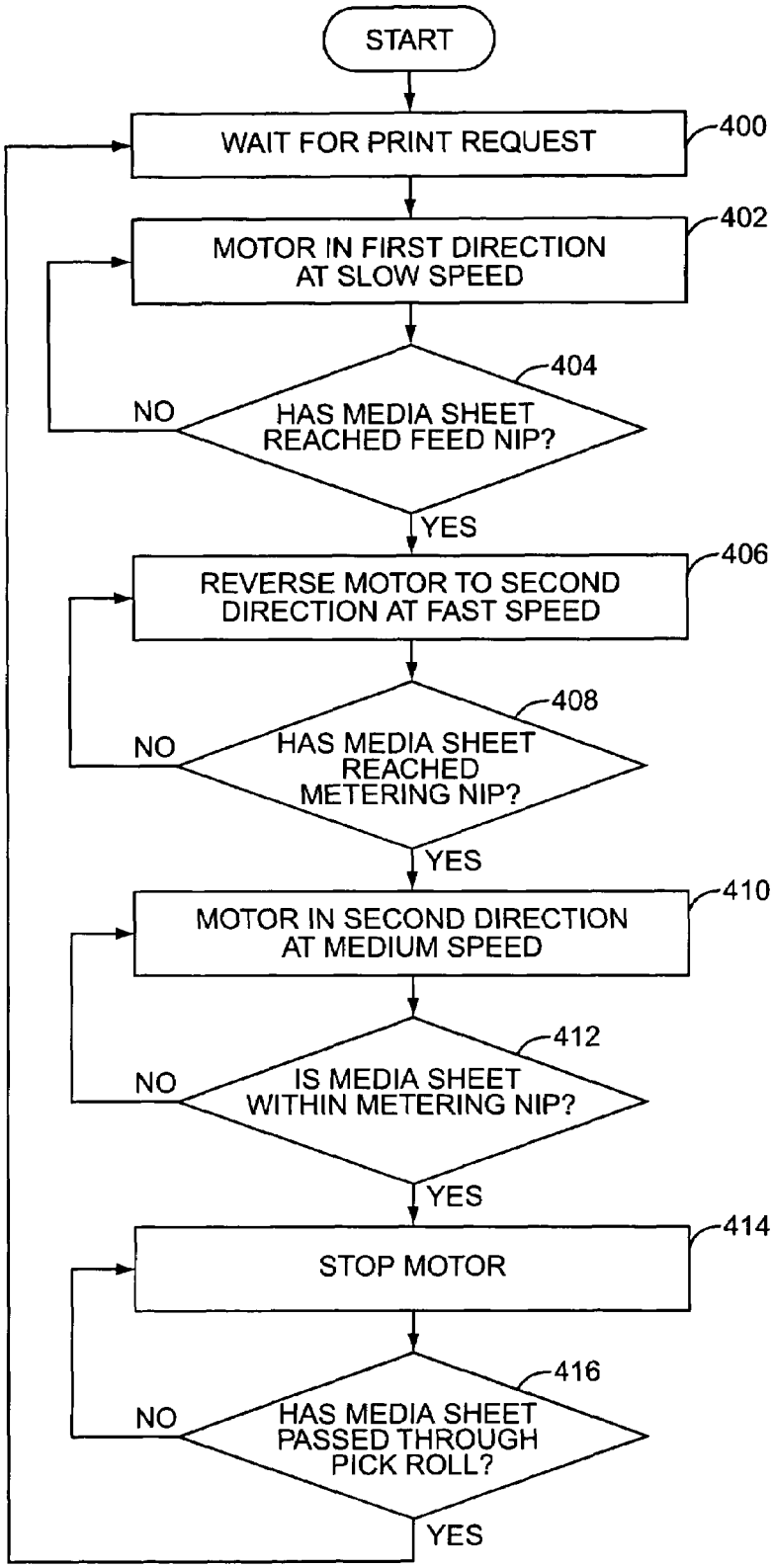
FIG. 4 is a flowchart diagram illustrating the steps of performing the invention according to one embodiment of the present invention.

FIG. 4 illustrates one method of picking media sheets from the input tray 59 according to the present invention. The operation begins with waiting for a pick request and the motor 60 stopped (step 400). A previous media sheet may be in the feed nip 55 and the metering nip 39 with the clutch 65 allowing the metering nip 39 to control the media movement. When a request for a pick is received, the motor 60 is driven in a first direction at a slow speed (step 402). In one embodiment, the speed is slightly slower than the normal media process speed, such as 2% slower. The slow speed ensures that any previous media sheet is not disturbed by the forward motion of the feed nip 55.

The slow speed continues in the first direction until the media sheet has reached the feed nip 55 (step 404). By this time, the previous media sheet has passed through and cleared the feed nip 55. The media sheet moves at the speed of the feed nip 55, which is slightly faster than the pick roll 53. The motor 60 then stops, changes direction and runs at a fast speed (step 406). The speed is faster than the normal process speed to reduce the amount of inter-page gap between the previous sheet and the current sheet. In one embodiment, the speed is about 25% faster. The clutch 56 allows the media sheet to move forward without interference from the pick roll 53.

The fast speed continues in the second direction until the media sheet reaches the metering nip 39 (step 408). By this time, any previous media sheet has already passed through and cleared the metering nip 39. The motor 60 still moves in the second direction and then slows down to a medium speed to match the normal process speed of the metering nip 39 (step 410). Metering nip 39 may be stopped or running in a reverse direction as the leading edge of the media sheet enters to align the leading edge as is well known in the art. Metering nip 39 then drives the media sheet forward at the normal process speed.

The medium speed continues in the second direction until the media sheet is controlled by the metering nip 39 (step 412). Motor 60 then stops with the clutch 65 allowing the media sheet to move forward without interference from the feed nip 55 (step 414). If the media sheet is still in contact with the pick roll 53, which occurs with long media such as legal length sheets, clutch 56 allows the sheet to move forward freely.

Motor 60 is held in a stopped condition until the trailing edge of the media sheet has cleared the pick roll 53 (step 416). This may occur immediately with short media, or there may be a delay for longer media sheets. When the media sheet has cleared the pick roll 53, the next pick request is enabled.

In this embodiment, the second gear set has a higher ratio than the first gear set causing the drive roll 57 to have a higher surface velocity than the pick roll 53. Media sheets controlled by both the pick roll 53 and the drive roll 57 are moved at a higher speed even though the motor 60 continues rotation at a constant speed in the first direction. In another embodiment, the gear ratios may be substantially the same such that the motor 60 operating at a constant speed results in the pick roll 53 and drive roll 57 having substantially the same surface velocities. Likewise, the second gear ratio may provide for the drive roll 57 to have a variety of surface velocities relative to the metering nip 39 when the motor 60 operates at the various speeds in both the first and second directions.

Figure 5:
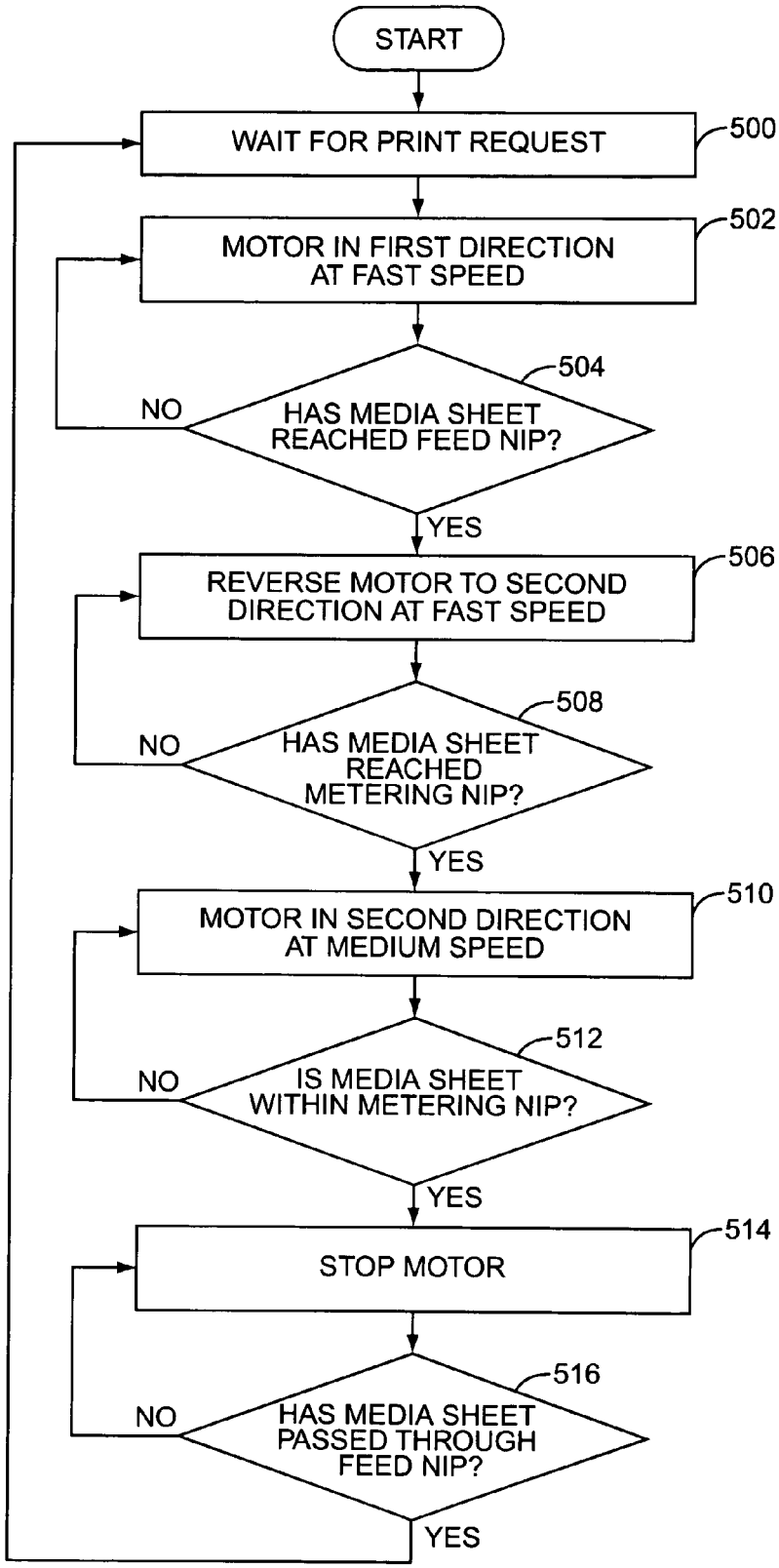
FIG. 5 is a flowchart diagram illustrating the steps of performing the invention according to another embodiment of the present invention.

FIG. 5 illustrates the steps of another method of picking media sheets. Initially, the motor 60 is stopped awaiting a pick request (step 500). When a pick request is received, motor 60 is driven in a first direction at a fast speed (step 502). The speed is faster than the normal process speed to reduce the inter-page gap with the previous sheet. In one embodiment, the fast speed is about 25% faster than the process speed.

The fast speed continues in the first direction until the media sheet has reached the feed nip 55 (step 504). Motor 60 then stops, changes direction, and runs in a second direction at a fast speed (step 506). The speed is again faster than the normal process speed to reduce the amount of inter-page gap between the previous sheet and the current sheet. In one embodiment, the fast speed in the second direction is about 25% faster than the process speed. The fast speeds in steps 502 and 506 may be the same, or may be different depending upon the application. In one embodiment, the fast speeds are the same. Clutch 56 allows the media sheet to move forward without interference from the pick roll 53.

The fast speed continues in the second direction until the media sheet reaches the metering nip 39 (step 508). Any previous media sheet has already passed through and cleared the metering nip 39 by this time. Motor 60 still running in the second direction then slows to a medium speed to match the process speed of metering nip 39 (step 510). The metering nip 39 may be stopped or running in a reverse direction as the leading edge of the media sheet enters to align the media sheet as is well known in the art. The metering nip 39 then drives the sheet forward at the process speed.

Motor 60 continues to run in the second direction at the medium speed until the media sheet is controlled by the metering nip 39 (step 512). The motor 60 then stops with clutch 65 allowing the media sheet to move forward without interference from the feed nip 55 (step 514). If the media sheet is still in contact with the pick roll 53, such as with long media, clutch 56 allows the media sheet to move forward freely.

Motor 60 is held in a stopped condition until the trailing edge of the media sheet clears the feed nip 55 (step 516). The next pick request is then enabled when the media sheet has cleared the feed nip 55.

Again in this embodiment, the first and second gear ratios may be established to rotate the pick roll 53 and the drive roll 57 at a variety of relative speeds, including the surface velocities to be substantially the same. Likewise, the second gear ratio may be established for a variety of surface velocities of the drive roll 57 relative to the metering nip 39.

The term "image forming device" and the like is used generally herein as a device that produces images on a media sheet. Examples include but are not limited to a laser printer, ink-jet printer, fax machine, copier, and a multi-functional machine. One example of an image forming device are Model Nos. C750 and C752 both available from Lexmark International, Inc. of Lexington Ky.

The embodiments illustrate a transfer belt 20 used for moving the media sheets past the image forming units 100. In another embodiment, nip rollers are used for holding and propelling the media sheets. Various other forms of media movement devices may also be used in the present invention.

The present invention may be carried out in other specific ways than those herein set forth without departing from the scope and essential characteristics of the invention. In one embodiment, the second roll 58 is free-spinning with the surface velocity controlled by the rotation of the drive roll 57 and therefore does not require a separate clutch. In one embodiment, the first arm and the second arm form an angle of between about 75-90°. The present embodiments are, therefore, to be considered in all respects as illustrative and not restrictive, and all changes coming within the meaning and equivalency range of the appended claims are intended to be embraced therein.

What is claimed is:

1. A method of moving a media sheet within an image forming apparatus comprising the steps of:

driving a motor at a first rate in a first direction to rotate a first roller in a forward direction and contacting the media sheet with the first roller to move the media sheet at a first speed along a first section of a media path;

driving the motor at the first rate in the first direction to rotate a second roller in the forward direction and contacting the media sheet with the second roller to move the media sheet at a second speed along a second section of the media path; and reversing the motor to a second direction and continue rotating the second roller in the forward direction and contacting the media sheet with the second roller to move the media sheet along the second section of the media path; and driving the motor in the second direction with the first roller contacting the media sheet and rotating freely as the media sheet is driven by the second roller.

2. The method of claim 1, further comprising moving the media sheet at a faster speed along the second section of the media path than along the first section of the media path.

3. The method of claim 1, further comprising rotating the motor at the first rate and moving the media sheet at the same speed along the first section of the media path and at least a portion of the second section of the media path.

4. An input device for an image forming device comprising:

an input tray;

a pick mechanism having a pick arm extending into the input tray and a pick roll positioned at a distal end to contact a media sheet within the input tray;

a feed nip positioned downstream from the pick mechanism a distance less than a length of the media sheet, the feed nip having a drive roll and a driven roll;

a motor that operates in a first direction and a second direction;

a first gear set extending between the motor and the pick mechanism to drive the pick roll at a first speed;

a second gear set extending between the motor and the drive roll to drive the drive roll at a second speed substantially equal to the first speed;

the second gear set comprising a swing arm pivotally positioned between a first orientation with a first gear contacting the drive roll when the motor operates in the first direction, and a second orientation with a second gear contacting the drive roll when the motor operates in the second direction.

5. An input device for an image forming device comprising:

an input tray;

a pick mechanism having a pick arm extending into the input tray and a pick roll positioned at a distal end to contact a media sheet within the input tray;

a feed nip positioned downstream from the pick mechanism a distance less than a length of the media sheet, the feed nip having a drive roll and a driven roll;

a motor that operates in a first direction and a second direction;

a first gear set extending between the motor and the pick mechanism to drive the pick roll at a first speed when the motor operates in the first direction;

a second gear set extending between the motor and the drive roll to drive the drive roll at a second speed greater than the first speed;

the second gear set comprising a swing arm pivotally positioned between a first orientation with a first gear contacting the drive roll when the motor operates in the first direction, and a second orientation with a second gear contacting the drive roll when the motor operates in the second direction.

6. The device of claim 5, further comprising a metering nip positioned downstream from the feed nip that operates at a third speed greater than the second speed, the feed nip having a clutch for the drive roll to rotate at the third speed when the media sheet is in contact with both the metering nip and the feed nip.

7. The device of claim 5, further comprising a clutch positioned within the pick mechanism that allows the pick roll to rotate at the second speed when the media sheet is in contact with both the feed nip and the pick roll and the motor is operating at a first speed.

8. The device of claim 6, further comprising a clutch positioned within the feed nip that allows the feed nip to rotate at the third speed when the media sheet is in contact with both the feed nip and the metering nip.

* * * * *